US012122575B2

(12) United States Patent
Pucci et al.

(10) Patent No.: US 12,122,575 B2
(45) Date of Patent: Oct. 22, 2024

(54) CLOSING CAP FOR A CONTAINER

(71) Applicant: SACMI COOPERATIVA MECCANICI IMOLA SOCIETA' COOPERATIVA, Imola (IT)

(72) Inventors: Fabrizio Pucci, Castel Guelfo di Bologna (IT); Fiorenzo Parrinello, Medicina (IT)

(73) Assignee: SACMI COOPERATIVA MECCANICI IMOLA SOCIETA' COOPERATIVA, Imola (IT)

( * ) Notice: Subject to any disclaimer, the term of this patent is extended or adjusted under 35 U.S.C. 154(b) by 426 days.

(21) Appl. No.: 17/598,605

(22) PCT Filed: Mar. 30, 2020

(86) PCT No.: PCT/IB2020/052997
§ 371 (c)(1),
(2) Date: Sep. 27, 2021

(87) PCT Pub. No.: WO2020/201908
PCT Pub. Date: Aug. 10, 2020

(65) Prior Publication Data

US 2022/0177205 A1 Jun. 9, 2022

(30) Foreign Application Priority Data

Apr. 4, 2019 (IT) ..... 102019000005112

(51) Int. Cl.
*B65D 51/28* (2006.01)
*B65D 81/32* (2006.01)

(52) U.S. Cl.
CPC ..... *B65D 51/2842* (2013.01); *B65D 51/2814* (2013.01); *B65D 51/2821* (2013.01); *B65D 51/2828* (2013.01); *B65D 81/3222* (2013.01)

(58) Field of Classification Search
CPC ..... B65D 51/2842; B65D 81/3211; B65D 81/3222; B65D 51/2814; B65D 51/2821; B65D 51/2828
See application file for complete search history.

(56) References Cited

U.S. PATENT DOCUMENTS 4,195,731 A * 4/1980 Cavazza ..... B65D 81/3222 366/602
4,221,291 A 9/1980 Hunt
(Continued)

FOREIGN PATENT DOCUMENTS

EP 2154081 A1 2/2010
KR 20050002775 A * 1/2005 ..... B65D 51/2842
(Continued)

*Primary Examiner* — Nathan J Jenness
*Assistant Examiner* — Jennifer Castriotta
(74) *Attorney, Agent, or Firm* — PEARNE & GORDON LLP

(57) ABSTRACT

A closing cap (1) for a container (2) includes an outer shell (3) having a longitudinal axis (X). The outer shell (3) comprises a lateral wall (301) which extends about the axis (X) and has a shape which is tubular and coaxial with the axis (X). An end wall (302; 317) closes the lateral wall (301) at one end and delimits a concavity. The lateral wall (301) is internally provided with a coupling structure (303) configured for removably coupling the cap (1) to a neck (201) of the container (2). An inner component (4; 4') includes a closing element provided with an inner portion (401; 401') and an outer flange (402). The closing cap (1) also comprises a containment chamber (5) and an opening promoting assembly (6).

21 Claims, 13 Drawing Sheets

(56) References Cited

U.S. PATENT DOCUMENTS

| | | | | | |
|---|---|---|---|---|---|
| 4,962,852 | A * | 10/1990 | Affaitati | B65D 51/2814 | 206/222 |
| 4,982,875 | A * | 1/1991 | Pozzi | B65D 81/3222 | 604/416 |
| 6,386,358 | B1 * | 5/2002 | North | B65D 75/326 | 206/217 |
| 6,921,087 | B2 * | 7/2005 | Takahashi | B65D 51/2878 | 206/219 |
| 7,562,782 | B2 * | 7/2009 | Yorita | B65D 51/2842 | 215/DIG. 8 |
| 2008/0202949 | A1 | 8/2008 | Morini et al. | | |
| 2010/0301002 | A1 * | 12/2010 | Deperrois | B65D 51/2842 | 220/521 |

FOREIGN PATENT DOCUMENTS

| | | | | | |
|---|---|---|---|---|---|
| KR | 20050008612 | A * | 1/2005 | B65D 51/2842 | |
| WO | 2012099501 | A2 | 7/2012 | | |

* cited by examiner

Fig.4
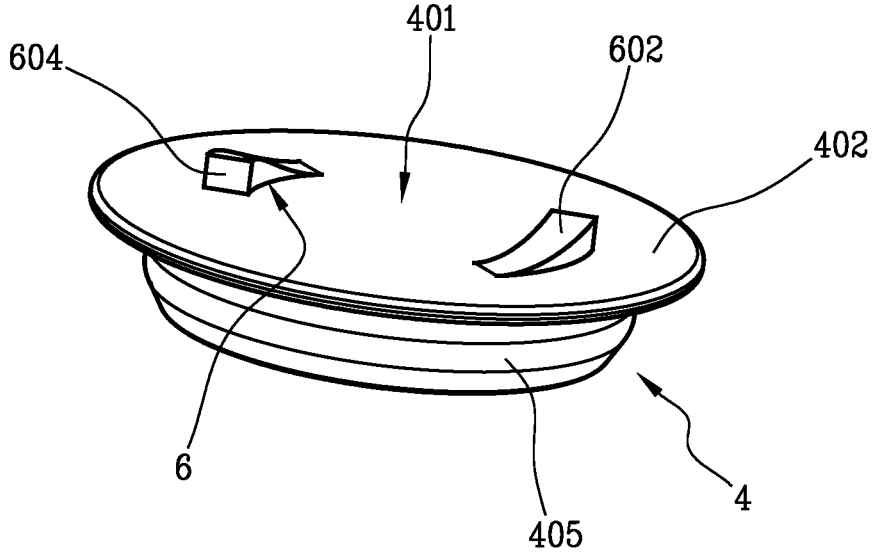
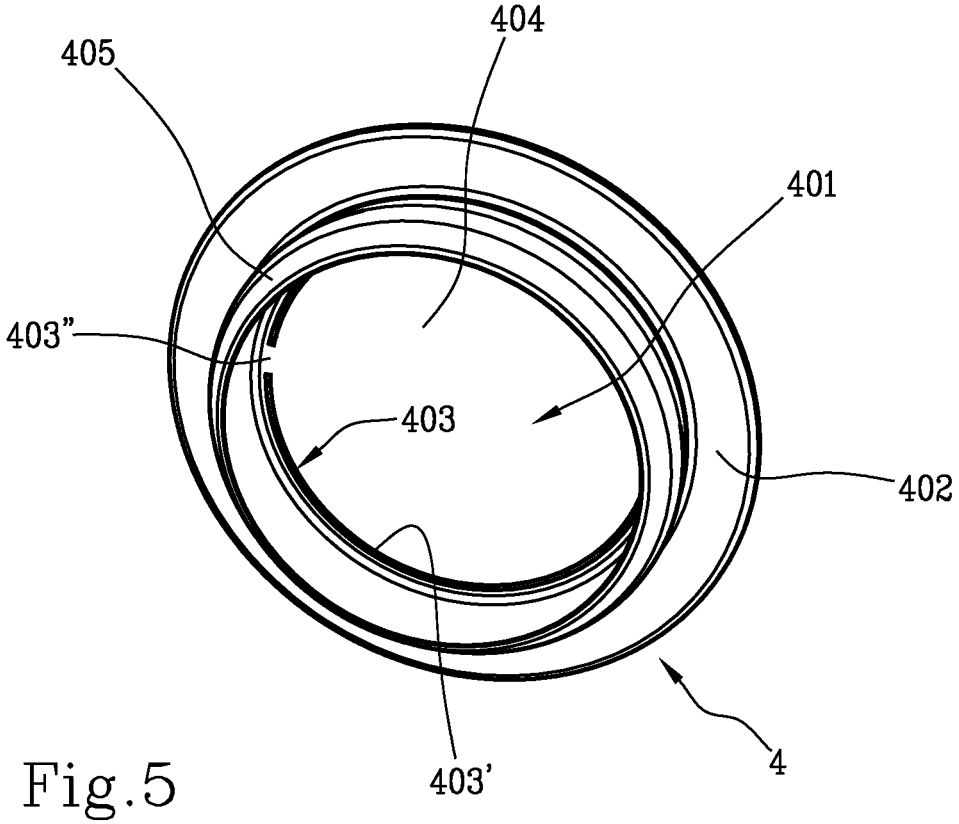
Fig.5

Fig.14
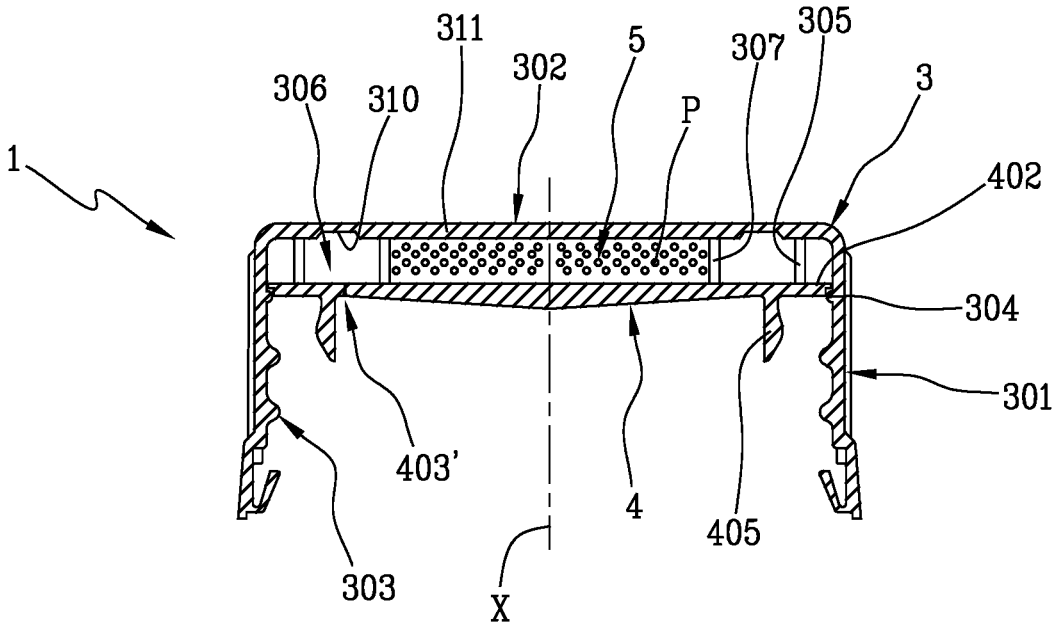
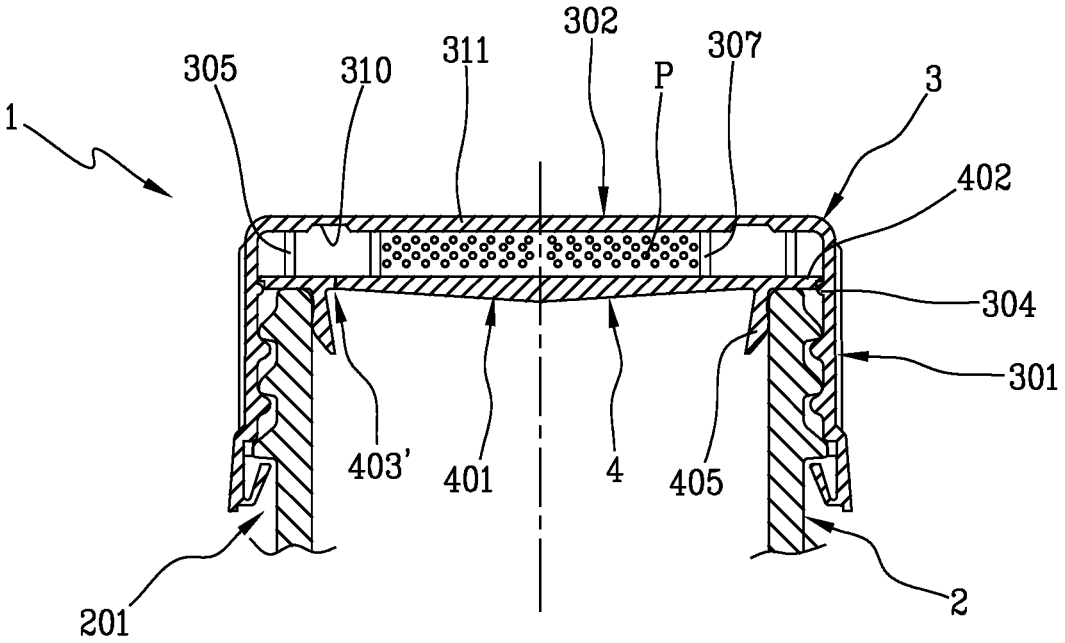
Fig.15

Fig.16
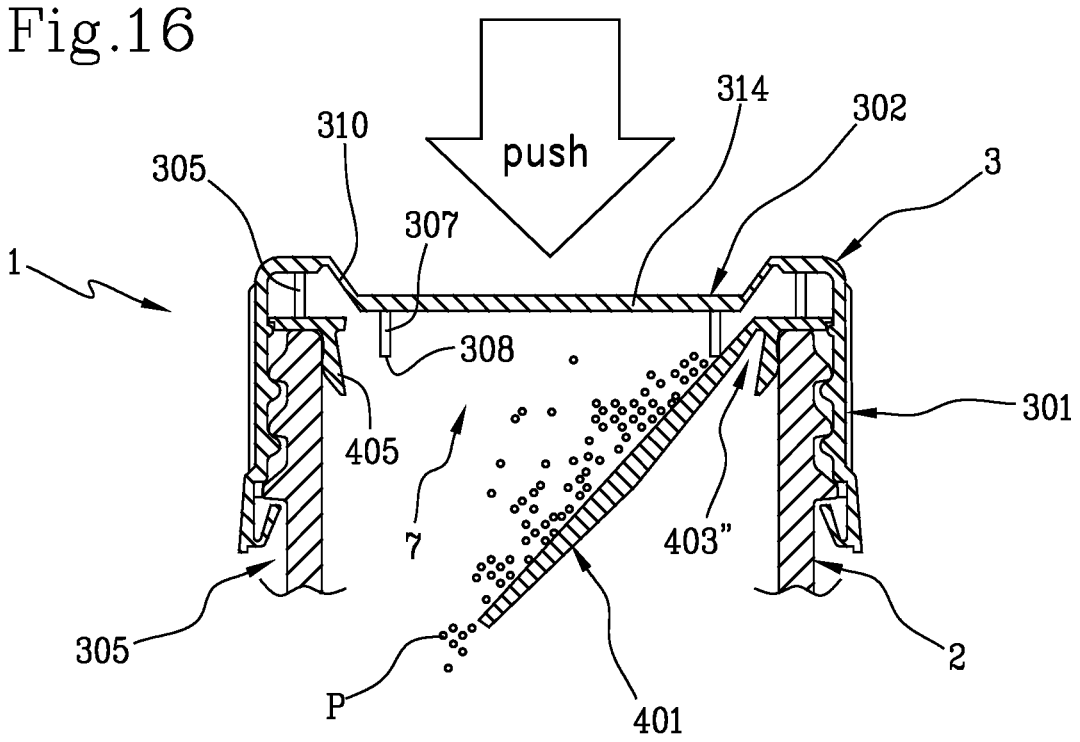
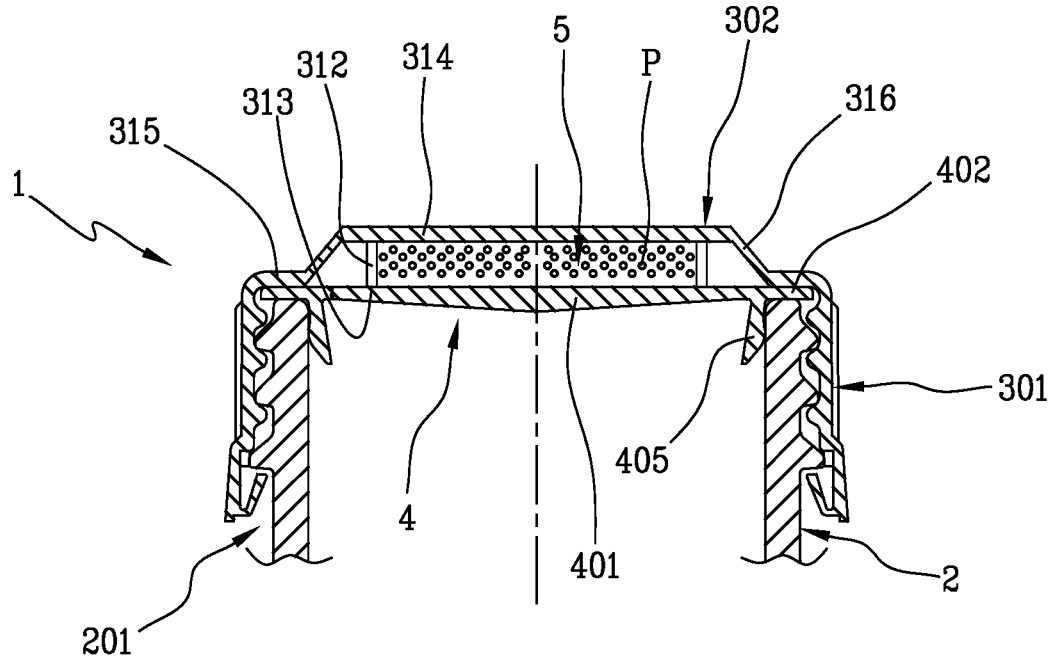
Fig.17

CLOSING CAP FOR A CONTAINER

The present invention relates to a closing cap for a container.

In particular, the present invention relates to a closing cap, for example a top, for bottles or other containers, made of plastic material, which can be placed for closing a mouth of the container and is configured for containing a product which can be supplied into the container through the self-same mouth.

Various types of closing caps are known, made of plastic material, substantially cylindrical in shape, which are equipped with an outer shell provided with a lateral wall, with tubular shape and coaxial with a longitudinal axis, and an end wall, which closes the lateral wall at one end for delimiting a concavity.

The lateral wall is internally provided with a coupling structure, typically a thread, configured for removably coupling the cap to a neck of the container in such a way that the cap is movable from a closing position, in which the cap closes a mouth of the container, to an opening position.

The cap may be provided with a tamper-evident ring or seal. That tamper-evident ring or seal is connected to a lower edge of the lateral wall by small bridges of material, which are positioned along a tear line, which may be spaced from each other, for example, using gaps or weakened portions. During a first movement of the closing cap towards the opening position, the tamper-evident ring engages with a stop ring of the neck of the container, whilst the small bridges break to separate the tamper-evident ring from the lateral wall of the closing cap. In this way, the closing cap can be removed from the neck of the container without the tamper-evident ring and provides a consumer with evidence that the container has been opened.

There are also prior art caps comprising a chamber, suitable for containing a product intended to be supplied into the container through the mouth. That product may be a powder, liquid or concentrated and pressurised. For example, the product may be a pharmaceutical substance or milk enzymes intended to be supplied into a single-dose vial or energy supplements intended to be supplied into bottles containing sports beverages.

Usually, such caps are used when the product contained in the chamber must be kept separate from the contents of the container at least until the moment of use.

For example, it is necessary to use a closing cap provided with the product containment chamber, in cases in which some of the ingredients of the product are unstable when they are incorporated in a solution.

In order to delimit the containment chamber and to allow the containment chamber to be opened so as to supply the product into the container, these closing caps comprise, not just the outer shell, but also further inner components.

These closing caps are usually complex and therefore expensive, since the further inner components have a complex geometry, derived from the need to interact with each other, in such a way as to open the containment chamber.

Moreover, often the various components of the closing cap are made of materials which are different to each other and, therefore, for waste disposal and recycling, this means that the cap must be classed as undifferentiated waste, since it is difficult to separate each material from the others.

The closing caps currently available may be substantially improved upon as regards the technical need summarised above.

The aim of this invention is to improve upon the closing caps currently available.

Another aim of this invention is to provide a closing cap which is simple and inexpensive to make.

A further aim of this invention is to provide an improved closing cap for the purpose of correct waste disposal.

Those aims and others are achieved by a closing cap according to one or more of the appended claims.

Further characteristics and advantages of this invention are more apparent from the non-limiting description which follows of a preferred, non-limiting embodiment of a closing cap, illustrated in the accompanying drawings, in which:

FIG. 4 is an axonometric view of the inner component of FIG. 1 to which an inner promoting element of the opening promoting assembly is fixed;

FIG. 5 is an axonometric view, from inside, of the inner component of FIG. 4;

FIG. 14 is a cross-section of another variant of the cap of FIG. 1 comprising the outer shell, the inner component and the opening promoting assembly, in which the opening promoting assembly comprises a deforming element for deforming an end wall and an abutment edge of a containment wall of the product containment chamber;

FIG. 15 is a cross-section of the cap of FIG. 14, removably coupled to a neck of a container;

FIG. 16 is a cross-section of the cap of FIG. 15, at the end of supplying of the product contained in the chamber;

FIG. 17 is a cross-section of another further variant of the cap of FIG. 1, comprising the outer shell, the inner component and the opening promoting assembly, in which the opening promoting assembly comprises a connecting part for connecting an end wall and a contact edge of a part for delimiting the product containment chamber;

It should be noticed that elements common to the different embodiments will be labelled with the same reference characters.

Figure 1:
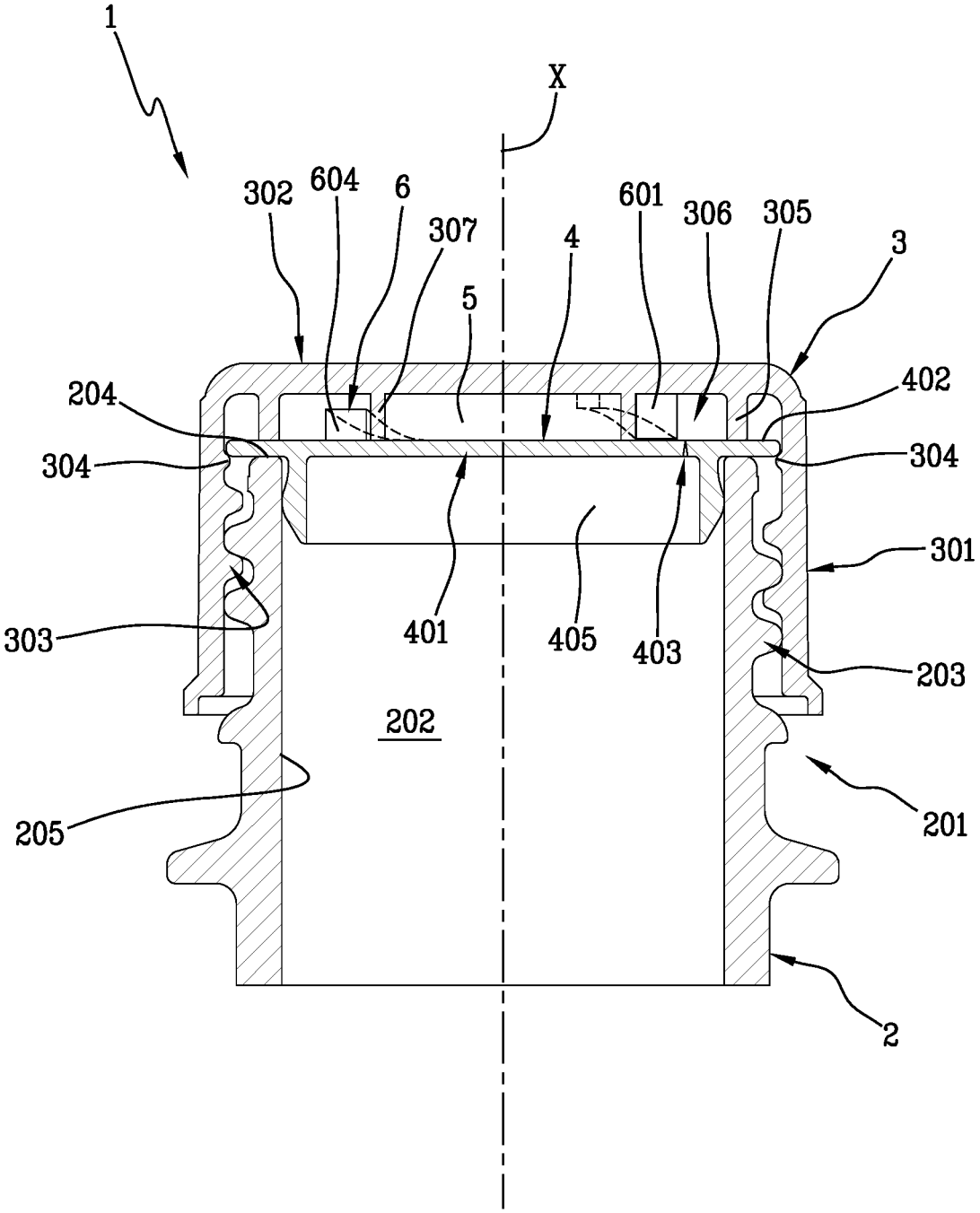
FIG. 1 is a cross-section of an axonometric view of a cap according to this invention removably coupled to a neck of a container, comprising a shell, an inner component, an opening promoting assembly, a product containment chamber and in which the inner component comprises a closing element for closing a mouth of the neck, which is placed so as to partly close the containment chamber.
Figure 2:
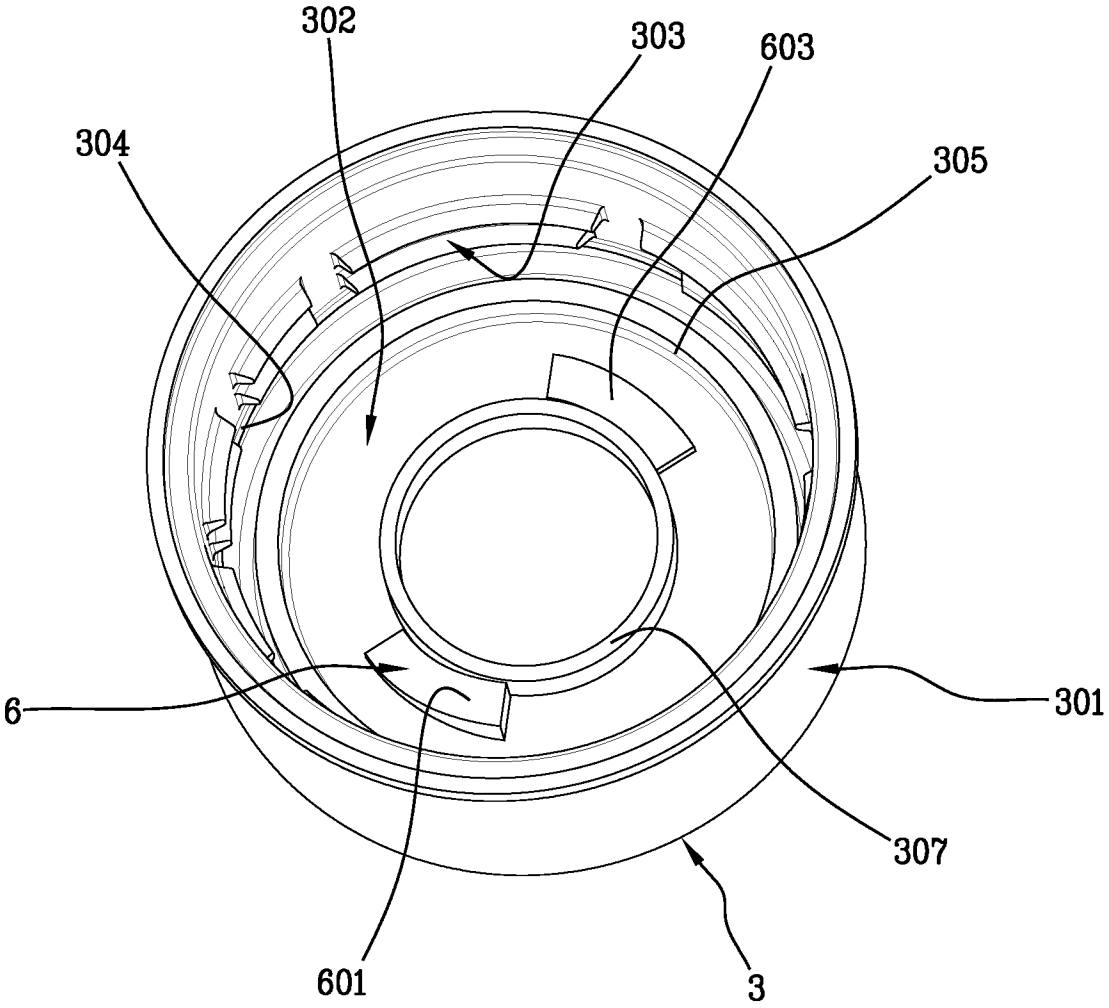
FIG. 2 is an axonometric view, from inside, of the outer shell of FIG. 1 to which an outer promoting element of the opening promoting assembly is fixed.
Figure 3:
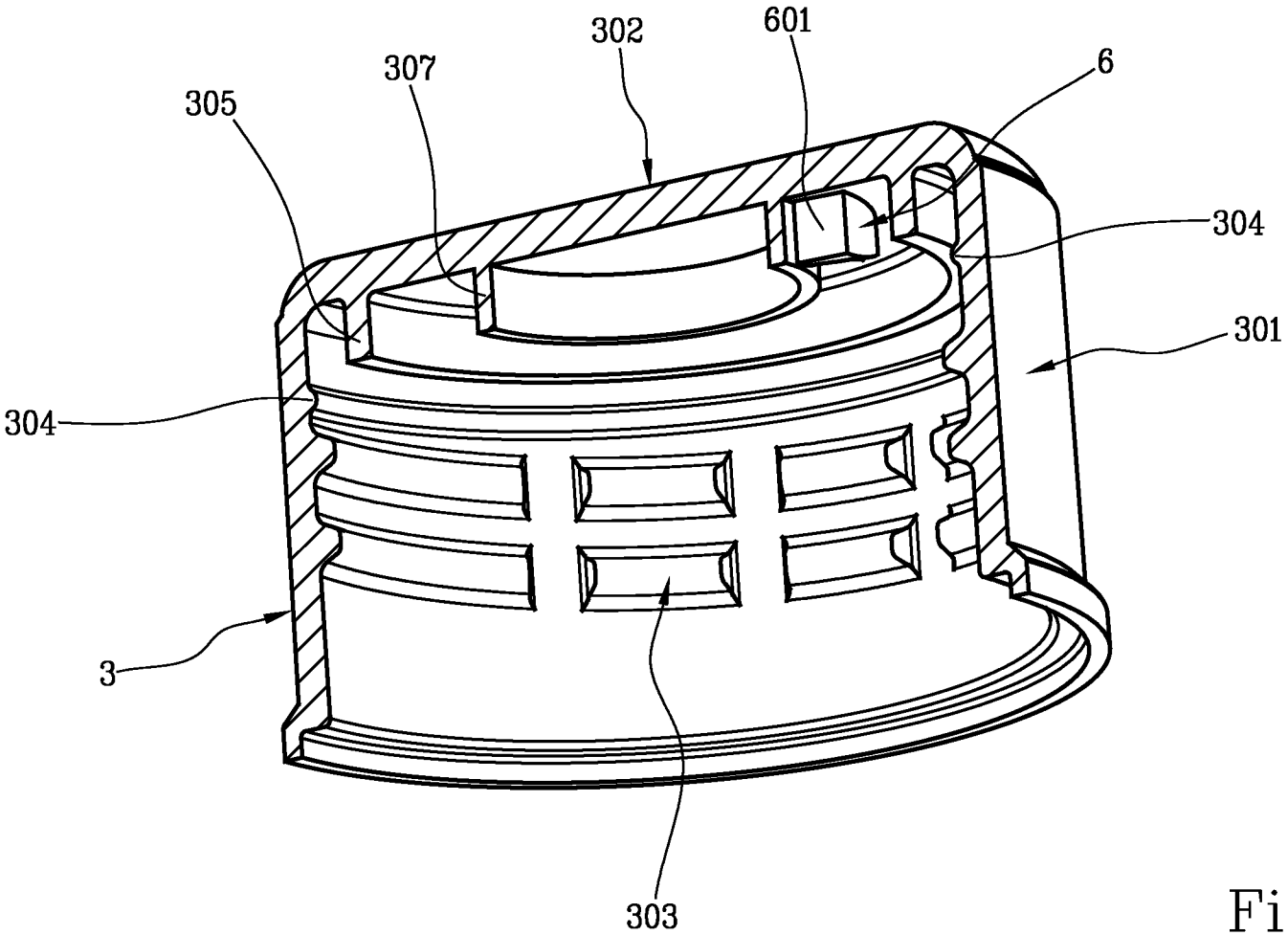
FIG. 3 is a cross-section of the axonometric view of the outer shell of FIG. 2.

With reference to the accompanying FIGS. 1 to 18, the numeral 1 denotes a closing cap 1 for a container 2, only a neck 201 of the container being shown. The container 2 may be a bottle but may also be of another type without limiting the scope of the invention.

The closing cap 1 comprises an outer shell 3 which has a longitudinal axis X and comprises a lateral wall 301 which extends about the axis X.

Specifically, the lateral wall has a shape which is tubular and is coaxial with the axis X.

The outer shell 3 also comprises an end wall 302, which closes the lateral wall 301 at one end for delimiting a concavity.

The end wall 302 is perpendicular to the lateral wall 301 and is planar.

It should be noticed that the lateral wall 301 is internally provided with a coupling structure 303, configured for removably coupling the cap 1 to the neck 201 of the container 2, in such a way that the cap 1 is movable from a closing position, in which the cap closes a mouth 202 of the container 2, to an opening position.

The coupling structure 303 is shaped for engaging with a corresponding coupling structure 203 present on the outside of the neck 201 of the container 2. The coupling structure 303 of the outer shell 3 and the coupling structure 203 of the neck 2 are, for example, made in the form of a thread. In this case, the movement from the closing position to the opening position is performed by means of a rotation of the outer shell 3 relative to the neck 201 of the container 2.

The cap 1 also comprises an inner component 4, configured for closing the mouth 202 of the container 2, when the cap 1 is in the closing position. The inner component 4 comprises a closing element, provided with an inner portion 401, which is configured, in use, for facing the mouth 202, and an outer flange 402, extending externally relative to the inner portion 401, which is configured for fixing to the outer shell 3.

It should be noticed that in the accompanying FIGS. 1 to 18, preferably, the closing element is also configured for making contact with an edge 204 of the neck 201. In fact, the inner portion 401 is facing the mouth 202 and extends as far as the edge 204 for closing the mouth 202, whilst the outer flange 402 extends externally relative to the edge 204. However, according to one variant not illustrated, the closing element may also not be in contact with the edge 204 of the neck 201 if the closing element is, in use, at a distance from the edge 204.

Figure 18:
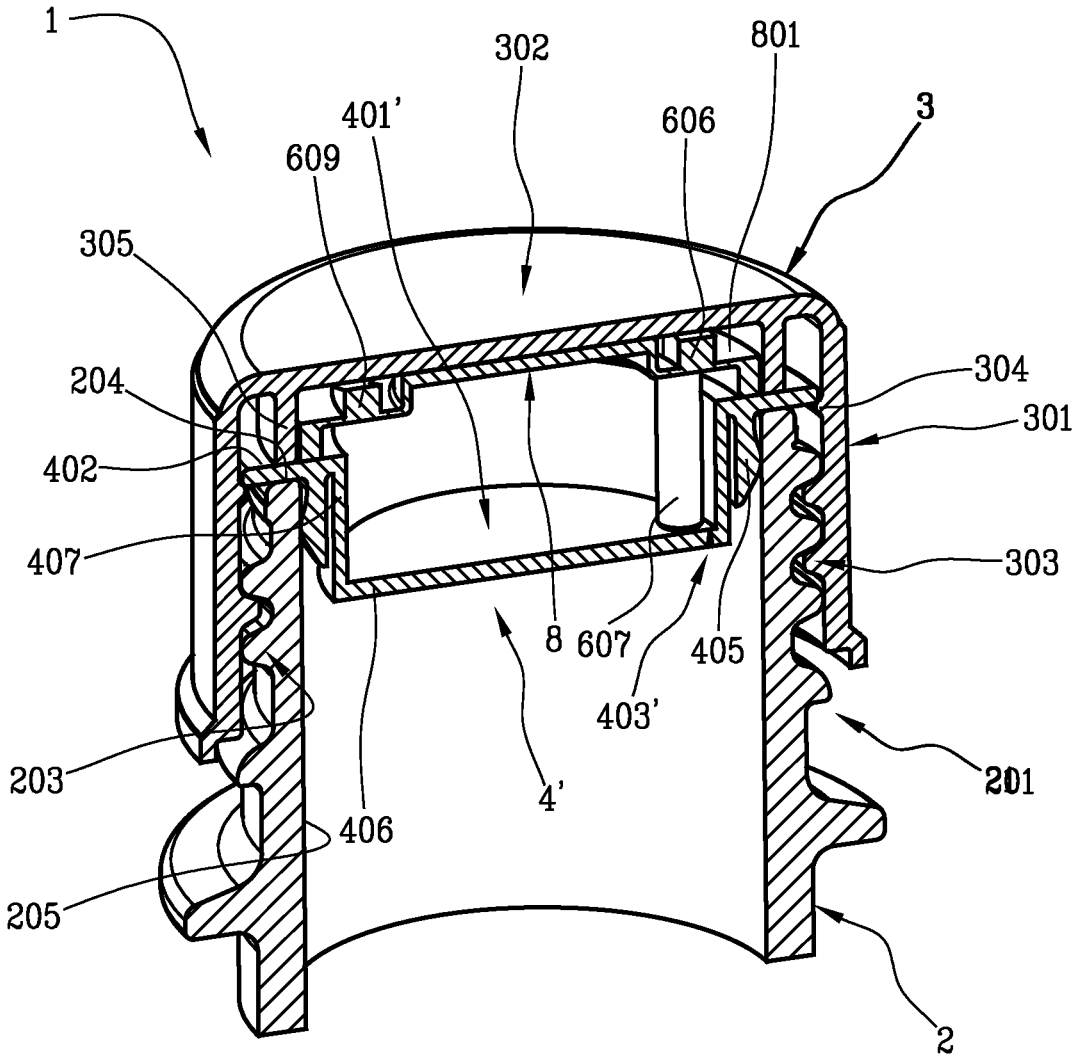
FIG. 18 is an axonometric cross-section of a variant of the cap of FIG. 10, showing a variant of the inner component.

In detail, the inner component 4 may have the closing element shaped like a planar disk in the sense that the inner portion 401 is planar and extending from it, in a planar way, is the outer flange 402, as shown in FIGS. 1 to 17. Alternatively, as shown in FIG. 18 and described in more detail below, the closing cap 1 may comprise an inner component 4' which has the closing element wherein the inner portion 401' has the shape of a cup-shaped body and the outer flange 402, which extends from the inner portion 401', is planar.

The outer flange 402 may, for example, make contact by interference with the lateral wall 301 of the outer shell 3 in such a way that the inner component 4 is retained inside the outer shell 3. Optionally, as shown in the accompanying figures, the lateral wall 301 is also internally provided with a hooking element 304, which is interposed between the coupling structure 303 and the end wall 302. The hooking element 304 may have the shape of an annular rib, which extends circumferentially completely or in angularly equally spaced stretches. Alternatively, according to a version not illustrated, the hooking element 304 may be shaped like a pair of annular ribs which between them form a seat, shaped for receiving by shape coupling the outer flange 402 for fixing to the outer shell 3.

Thanks to the hooking element 304, the outer flange 402 remains securely fixed to the outer shell 3 even when the cap is moved by a user from the closing position to the opening position and moves away from the container 2.

The closing cap 1 additionally comprises a chamber 5 suitable for containing a product P (illustrated in FIGS. 14 to 17) intended to be supplied into the container 2 through the mouth 202.

The chamber 5 is at least partly delimited by the inner portion 401 or, as indicated below, by the inner portion 401'.

The closing cap 1 comprises an opening promoting assembly 6 and the inner portion 401 comprises a breakable portion 403. The opening promoting assembly 6 is configured for axially stressing the breakable portion 403 in such a way as to create a supplying outlet 7 in the inner portion 401 and to make the product P come out of the chamber 5, thereby supplying the product into the container 2 through the mouth 202.

Thanks to the closing cap 1 according to this invention it is possible to contain a product P in a chamber 5 in a simple and inexpensive way. In fact, it is enough that the cap 1 comprises an outer shell 3, to which an inner component 4 is fixed, closing a containment chamber 5 for a product P, and an opening promoting assembly 6 capable of axially stressing an inner portion 401 of the inner component 4 so that the inner portion 401 breaks to create the supplying outlet 7 and to make the product P come out of the chamber 5.

It should be noticed that the outer shell 3 and the inner component 4 may be made of the same material, for example HDPE, PP or PET, and that allows many advantages not only in terms of production efficiency but also for waste disposal, since the whole cap 1 can be classed as plastic material. According to one alternative embodiment, the outer shell 3 and the inner component 4 may be made using a multi-layer material, comprising a layer which is a barrier to gases, flavourings or light, or even using a recycled plastic material.

Advantageously, it is sufficient to have only two pieces which are different from each other, such as the outer shell 3 and the inner component 4, in order to make in a simple and inexpensive way the cap 1 according to this invention comprising the containment chamber 5.

As illustrated in FIGS. 1 to 16, the outer shell 3 comprises a spacer wall 305, which extends from the end wall 302 and internally relative to the lateral wall 301 to define a free space 306 between the end wall 302, the spacer wall 305 and the closing element.

It should be noticed that the spacer wall 305 is on the inside of the lateral wall 301 and is, for example, coaxial with it and annular. The spacer wall 305 is configured for making contact with the closing element and for spacing the inner component 4 from the end wall 302. For example, advantageously, the spacer wall 305 may make contact with the closing element at the edge 204 of the neck 201.

Advantageously, the spacer wall 305 acts as an end of stroke stop when a user moves the closing cap 1 from the opening position to the closing position, for closing the previously opened container again. However, according to alternative embodiments not illustrated, the spacer wall 305 may be absent from the closing cap 1, for example if a lower end edge of the shell 3, positioned on the opposite side to the end wall 302 is configured for making contact with a wall of the container 2, adjacent to the neck 201 and substantially transversal relative to the axis X, which acts as an end of stroke stop for stopping the movement of the cap 1 in the closing position, that is to say, during rotation of the cap 1 to the closing position relative to the container 2.

As illustrated in FIGS. 1 to 9, the opening promoting assembly 6 comprises an outer promoting element fixed to the outer shell 3 and an inner promoting element fixed to the inner portion 401, which operate in conjunction with each other during a movement of the cap 1 from the closing position to the opening position for creating the supplying outlet 7.

The outer promoting element and the inner promoting element respectively comprise a cam 601 and a cam follower 602 which are configured for making contact and for producing a gradually increasing axial shifting between the end wall 302 and the inner portion, during the movement of the cap from the closing position to the opening position, and, that is to say, during rotation of the cap 1 to the opening position relative to the container 2, in such away as to axially stress the breakable portion 403.

Thanks to the outer promoting element and to the inner promoting element, which are respectively fixed in a single body to the end wall 302 and to the inner portion 401, very simple and inexpensive components are used to create the supplying outlet 7 in the inner portion 401.

The cam 601 and the cam follower 602 are shaped like wedge-shaped projections with gradually increasing height and are shaped to match each other in such a way that the cam 601 gradually engages with the cam follower 602 during opening rotation of the cap 1, thereby gradually increasing the axial distance between the end wall 302 and the inner portion 401 in such a way as to gradually stress the self-same inner portion 401. The cam 601 and the cam follower 602, in plan view, are arranged along an annular strip for promoting their gradual engagement with each other during rotation.

It should be noticed that the outer shell 3 comprises a containment wall 307, which extends from the end wall 302 until it makes contact with the inner portion 401.

The chamber 5, for product P containment, is defined between the containment wall 307 and the end wall 302 and is closed by the inner portion 401.

Preferably, the product P contained in the chamber 5 is selected, for example having high particle size measurement, in such a way that it does not come out of the chamber 5 even if the inner portion 401 is only placed in contact with the containment wall 307.

The containment wall 307 illustrated in the accompanying figures is annular and is on the inside relative to the spacer wall 305. In particular, the containment wall 307 is coaxial with the axis X, is positioned internally relative to the spacer wall 305 and is therefore positioned in the free space 306.

However, it should be noticed that the containment wall 307 could have different shapes and be positioned not coaxial with the axis X. For example, according to a variant not illustrated in the accompanying figures, the cap 1 may comprise two different containment chambers, positioned in the free space 306, and suitable for containing two separate products to be supplied into the container 2, which are both closed by the closing element.

The outer promoting element and the inner promoting element are positioned externally relative to the containment wall 307.

In detail, the outer promoting element and the inner promoting element are positioned in the free space 306, between the spacer wall 305 and the containment wall 307.

As shown in FIG. 5, the breakable portion 403 is, for example, annular and comprises a breaking stretch 403', which is weakened and extends over an angle of less than 360° and a hinge stretch 403", which is not weakened, around which a zone 404 delimited by the breaking stretch 403' can be rotated, for creating the supplying outlet 7 and for making the product P come out.

The breaking stretch 403' may be weakened, for example, due to a local reduction in the thickness of the material used to make the inner component 4, or by means of an incision made by a blade but not passing through the full thickness.

The containment wall 307 extends as far as the zone 404 delimited by the breaking stretch 403'. The containment wall 307 is therefore internal relative to the breaking stretch 403'.

Moreover, the cam 601 and the cam follower 602 are positioned internally relative to the breaking stretch 403', in the sense that the cam 601 and the cam follower 602 are positioned, in plan view, in an annular strip of the zone 404, which is internal relative to the breaking stretch 403'. That annular strip is positioned externally relative to the containment wall 307.

Advantageously, the presence of the breaking stretch 403' in the inner portion 401 in use allows the shape of the supplying outlet 7, for example circular, to be foreseen.

However, it should be noticed that a breaking stretch 403' is not necessary in the inner portion 401, since the material with which the inner portion 401 is made could be specially designed to tear when subjected to an axial stress. The breakable portion 403, and therefore the shape of the supplying outlet 7 would not be foreseeable in advance but, for some types of products P, for example those in the form of powders with high particle size measurement, this would not cause any problems.

The outer promoting element and the inner promoting element respectively comprise a further cam 603 and a further cam follower 604, which are angularly equally spaced relative to the cam 601 and the cam follower 602. The further cam 603 and the further cam follower 604 are wedge-shaped, with gradually increasing height, like the cam 601 and the cam follower 602. The cam 601 and the cam follower 602 are positioned at a distance from the hinge stretch 403" for producing stress to cause a first break of the breakable portion 403, during an initial movement step of the cap 1 from the opening position to the closing position. In contrast, the further cam 603 and the further cam follower 604 are positioned near the hinge stretch 403" for increasing a dimension of the supplying outlet 7 after the first break.

In other words, thanks to the further cam 603 and the further cam follower 604, the dimensions of the supplying outlet 7 are amplified after the first break, since the angle of inclination of the zone 404 is amplified.

The further cam 603 and the further cam follower 604 are positioned in the same annular strip in which the cam 601 and the cam follower 602 are positioned.

However, it should be noticed that the further cam 603 and the further cam follower 604 are optional, in the sense that only the cam 601 and the cam follower 602 could be present.

As shown in FIGS. 1 to 18, the inner component 4 may also comprise a sealing element 405, advantageously applicable to all closing caps 1 described herein and those which will be described below.

The sealing element 405 extends from the closing element and is configured for being positioned inside the mouth 202 in such a way as to form a seal with an inner wall 205 of the neck 201 of the container 2. However, it should be noticed that the sealing element 405 may be shaped differently to what is shown in the accompanying figures, for example so as to form a seal with an outer wall of the neck 201 rather than with the inner wall 205.

Figure 6:
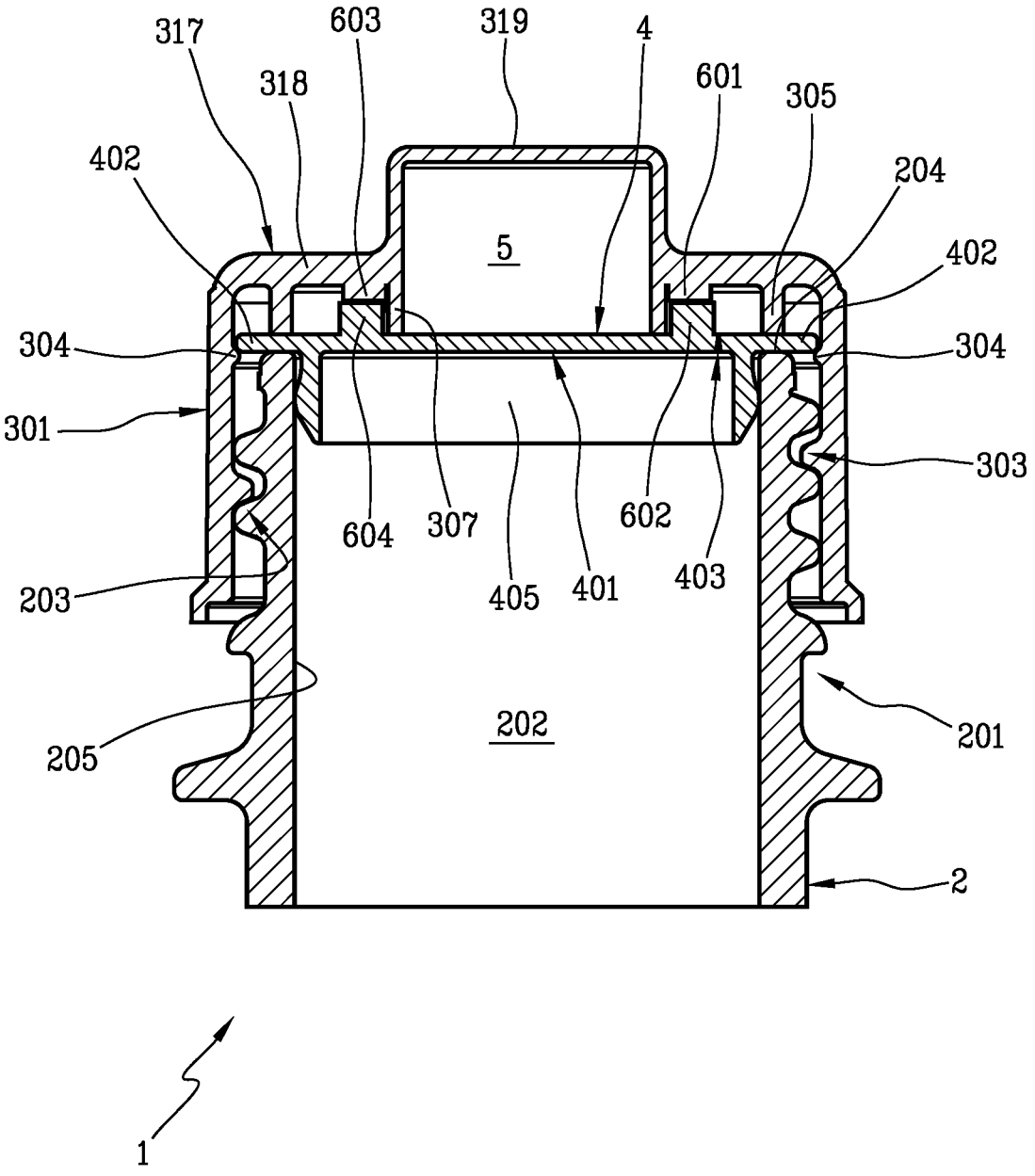
FIG. 6 is a cross-section of an axonometric view of a variant of the cap of FIG. 1, which includes a variant of the outer shell in which an end wall has double height.

According to one variant of the cap 1 disclosed, shown in FIG. 6, the shell 3 comprises an end wall 317 shaped to have double height. In fact, the end wall 317 has an outer annular zone 318, which extends from the lateral wall 301, having a first distance from the closing element, equal to the height of the spacer wall 305, and a central zone 319, which has a second distance from the closing element, greater than the first distance, for making the central zone 319 project outwards and define a larger containment chamber 5.

It should be noticed that the outer annular zone 318, in detail, extends as far as the containment wall 307 and that the central zone 319 is externally delimited by the containment wall 307. The central zone 319 projects axially outwards beyond the outer annular zone 318, for increasing the size of the containment chamber 5.

Relative to the closing cap shown in FIGS. 1 to 5, in use the operation of the cap 1 shown in FIG. 6 does not change, during its movement from the closing position to the opening position. For this reason, hereinafter reference will be made to the cap of FIGS. 1 to 5 and not to the cap of FIG. 6, without thereby limiting the scope of the invention.

Figure 7:
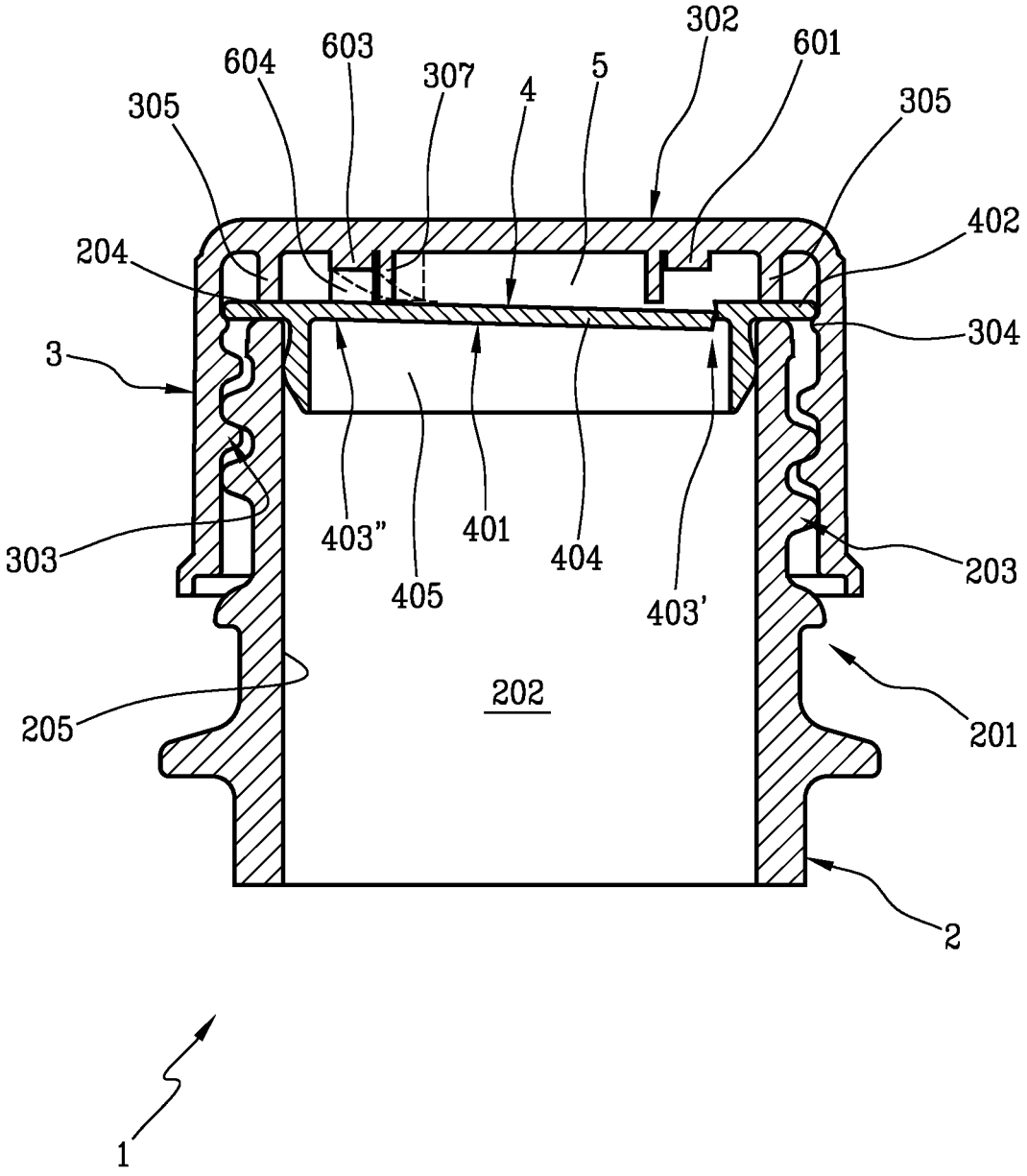
FIG. 7 is a cross-section of the cap of FIG. 1, joined to the neck of a container, in a starting step of movement from the closing position to the opening position, for creating a supplying outlet in the closing element.

In use, as shown in FIG. 7, the cap 1 is coupled to the neck 201 of the container 2 and is in an initial movement step from the closing position to the opening position, in which the outer shell 3 is rotated relative to the neck 201. The outer shell 3 begins moving axially away from the container 2 whilst the outer flange 402 of the closing element remains hooked to the outer shell 3 thanks to the hooking element 304. However, simultaneously, the sealing element 405 is retained by friction against the inner wall 205 of the neck 201 and, therefore, the inner component 4 does not rotate together with the shell 3 but is retained in position by the friction with the container 2 itself.

The outer promoting element, made as the cam 601, fixed to the outer shell 3, begins engaging with the inner promoting element, made as the cam follower 602, and in that way parts of the cam 601 and the cam follower 602 having gradually increasing height engage with each other, generating the axial stress in the breaking stretch 403' of the breakable portion 403, near the hinge stretch 403", for causing the creation of the supplying outlet 7 in the inner portion 401.

As a result of the axial stress applied on the inner portion 401, the friction between the sealing element 405 and the inner wall 205 tends to increase and this helps to stop rotation of the inner component 4 relative to the shell 3. There may be further hooking elements between the inner component 4 and the neck 210, if necessary, for further stopping that rotation.

After creation of the supplying outlet 7, the containment chamber 5 is open and the product P present in it can come out so that it can be supplied into the mouth 202.

The closing element, with the shape of a planar disk, begins deforming at the centre since it is stressed towards the container 2 at the inner portion 401 and is stressed on the opposite side at the outer flange 402.

Figure 8:
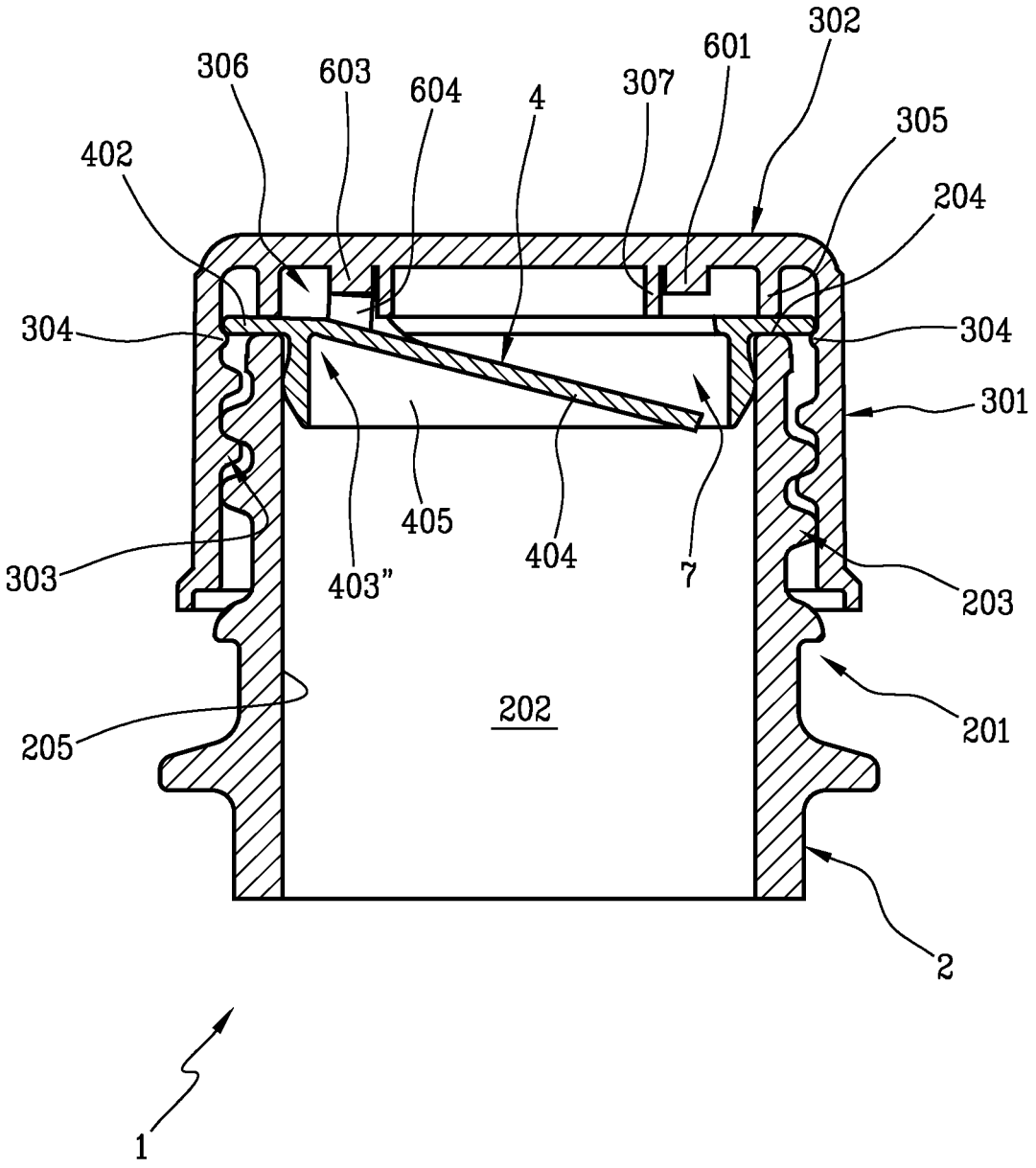
FIG. 8 shows the cap of FIG. 6, in a further movement step, following the initial step.

During a further movement step, after the initial step and shown in FIG. 8, the further cam 603 begins to engage with the further cam follower 604 in such a way as to stress the inner portion 401 on the opposite side to the cam 601 and to the cam follower 602, for increasing the dimensions of the supplying outlet 7. The stress due to the further cam 603 and to the further cam follower 604 causes a greater inclination of the zone 404 delimited by the breaking stretch 403' around the hinge stretch 403" and positions it inside the mouth 202.

Figure 9:
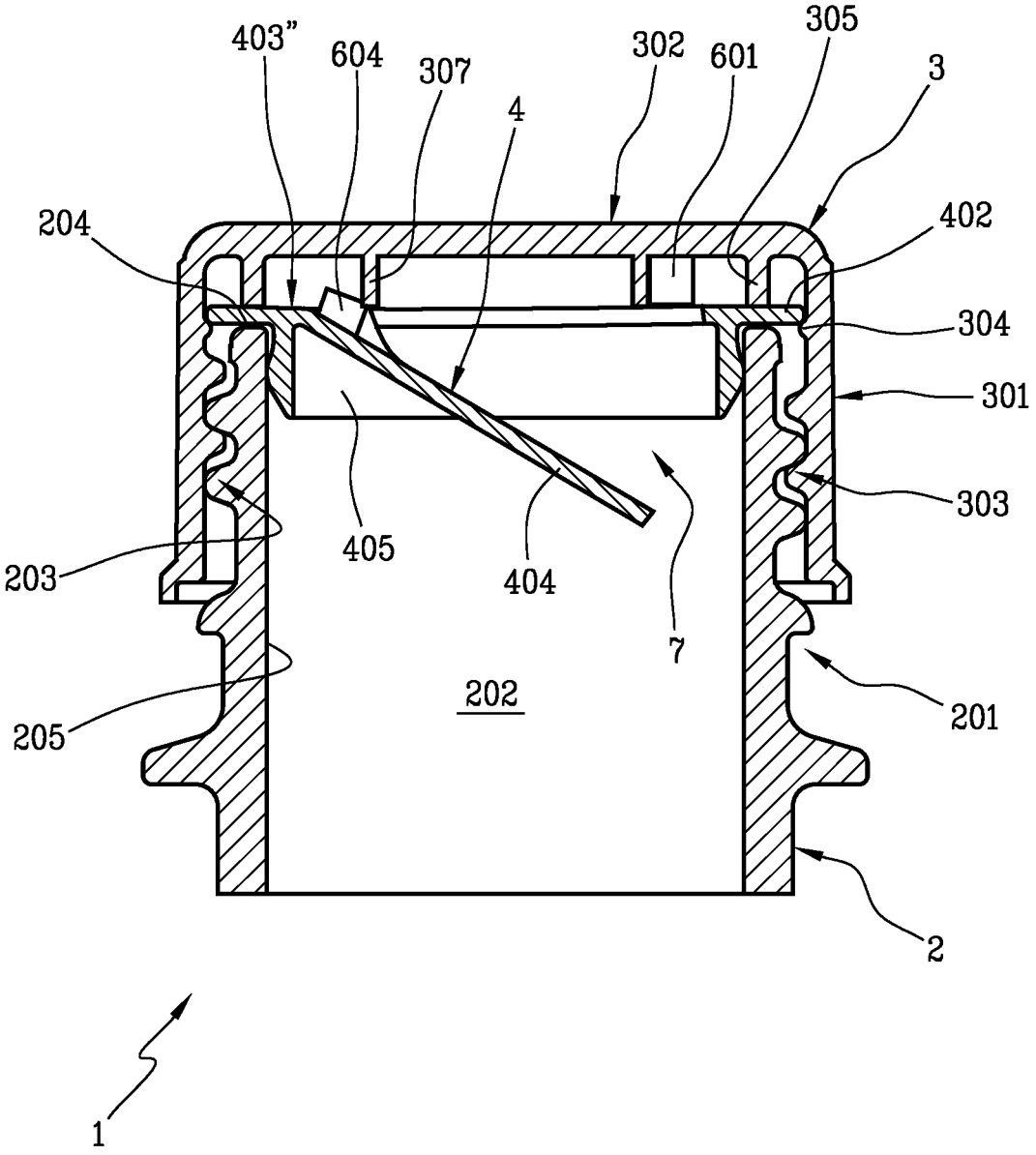
FIG. 9 shows the cap of FIG. 7, in another further movement step, following the further step.

In another further movement step, after the further step and shown in FIG. 9, it should be noticed that the supplying outlet 7 has the maximum size. It should also be noticed that, although the product P has already been supplied into the container 2 through the mouth 202, the coupling structure 303 of the outer shell is not yet completely disengaged from the coupling structure 203 of the container 2 in order to guarantee that the product P is supplied into the container 2 when the cap 1 is still joined to the container 2.

FIGS. 10 to 13 show a variant of the cap 1 disclosed which comprises an additional element 8 fixed to the closing element and comprising a containment cavity for the product P, the inner portion 401 sealingly closing the cavity to form the containment chamber 5.

In detail, the additional element 8 is interposed between the end wall 302 and the closing element.

In more detail, the additional element is positioned in the free space 306.

The additional element 8 comprises an intermediate wall 801, which is interposed between the end wall 302 and the closing element.

Thanks to the cavity present in the additional element 8 and to the fact that the closing element sealingly closes that cavity, being fixed in a single body to the additional element 8, the containment chamber 5 is hermetically closed.

Advantageously, if the chamber 5 is hermetically sealed, the product P contained in it may even be liquid, viscous or a powder with very fine particle size measurement and protection against moisture and oxygen is guaranteed. If required, the product P may also have carbon dioxide CO2 or nitrogen N2 added to it, so that it can be forcefully sprayed into the container 2 obtaining good pre-mixing.

The hermetic seal guarantees that the product P contained in the additional element 8 cannot be inadvertently supplied into the container 2 before the cap opening movement.

It should be noticed that the additional element 8 extends from the end wall 302 to the closing element and has a first volume V1, in contact with the end wall 302, which has a cylindrical shape and has a first diameter which is less than a second diameter of a second volume V2, also cylindrical, in contact with the closing element. In this way, the additional element 8 has an annular step, whose outer annular wall is actually the intermediate wall 801. However, it should be noticed that the additional element 8 could have a different shape, for example it could be shaped like a cup-shaped cylindrical body without a change of diameter, in which case the intermediate wall 801 would correspond to a bottom wall of the additional element 8.

The outer shell 3 of this variant of the cap 1 corresponds to the outer shell 3 previously described, which therefore will not be described again.

Optionally, according to one variant of the cap not illustrated, the outer shell 3 may comprise, alternatively to the flat end wall 302, the previously described end wall 317 shaped with double height, in which the central zone 319 projects outwards relative to the outer annular zone 318. The first volume V1 of the additional element 8 may advantageously be housed in the central zone 319 and be made with an increased space, in such a way that the containment chamber 5, defined in the additional element 8 can be made with an increased size.

The opening promoting assembly 6 comprises an upper promoting element, fixed to the outer shell 3 and an intermediate promoting element fixed to the intermediate wall 801.

In addition, the opening promoting assembly 6 comprises a supporting element, positioned in the chamber 5, between the intermediate wall 801 and the closing element. The upper promoting element, the intermediate promoting element and the supporting element operate in conjunction with each other during the movement of the cap 1 from the closing position to the opening position for creating the supplying outlet 7.

In detail, the upper promoting element and the intermediate promoting element respectively comprise a cam, not illustrated, and a cam follower 606 which are configured for making contact and for producing a gradually increasing axial shifting between the end wall 302 and the intermediate wall 801, during the movement of the cap 1 from the closing position to the opening position.

The supporting element comprises a pin 607, positioned axially aligned with the cam follower 606, in such a way that the latter axially stresses the pin 607 and the pin 607 consequently stresses the inner portion 401. The pin 607 is fixed in a single body to the additional element 8. In more detail, the pin 607 is fixed in a single body to the intermediate wall 801 and extends in the containment chamber 5.

For this variant of the cap 1 too, what was previously said applies about the breakable portion 403, which may optionally be present in the inner portion 401, and may comprise the weakened breaking stretch 403', and the non-weakened hinge stretch 403".

Furthermore, the upper promoting element comprises a further cam, not illustrated, the intermediate promoting element comprises a further cam follower 609; the further cam and the further cam follower 609 being positioned angularly equally spaced relative to the cam and the cam follower 606.

As for the cap 1 described with reference to FIGS. 1 to 9, the cam and the cam follower 606 are positioned near the hinge stretch 403" for producing stress to cause a first break of the breakable portion 403, in an initial movement step of the cap 1, the further cam and the further cam follower 609 being positioned at a distance from the hinge stretch 403" for increasing a size of the supplying outlet 7 after the first break.

The supporting element comprises a further pin 610, positioned aligned with the further cam follower 609 in such a way that the latter axially stresses the further pin 610 and the further pin 610 consequently stresses the inner portion 401. The further pin 610 is also fixed in a single body to the additional element 8 and, in more detail, is fixed to the intermediate wall 801 and extends in the containment chamber 5.

Figure 10:
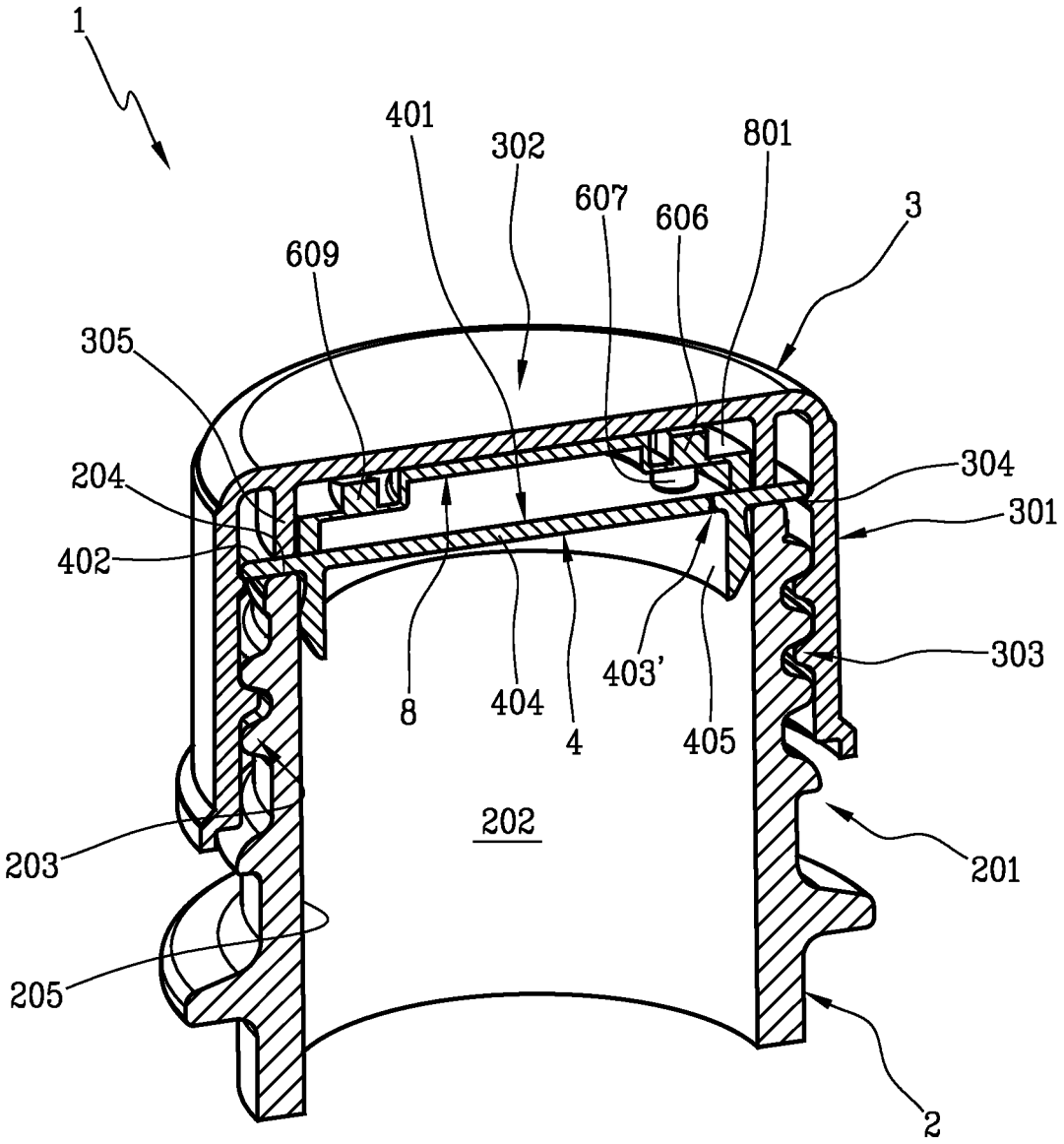
FIG. 10 is a cross-section of an axonometric view of a variant of the cap of FIGS. 1 to 9, removably coupled to a neck of a container, in which the cap comprises a shell, an inner component, an opening promoting assembly and an additional element fixed to the closing element of the inner component, which partly defines the product containment chamber.
Figure 11:
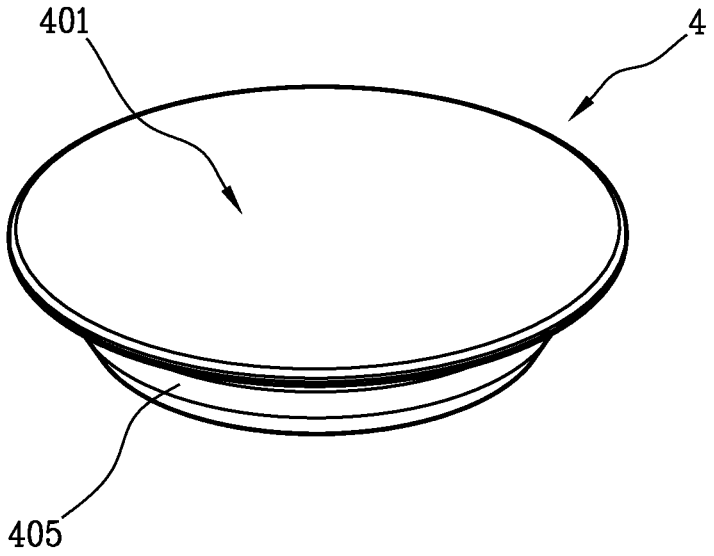
FIG. 11 is an axonometric view from outside of the inner component of FIG. 10.
Figure 12:
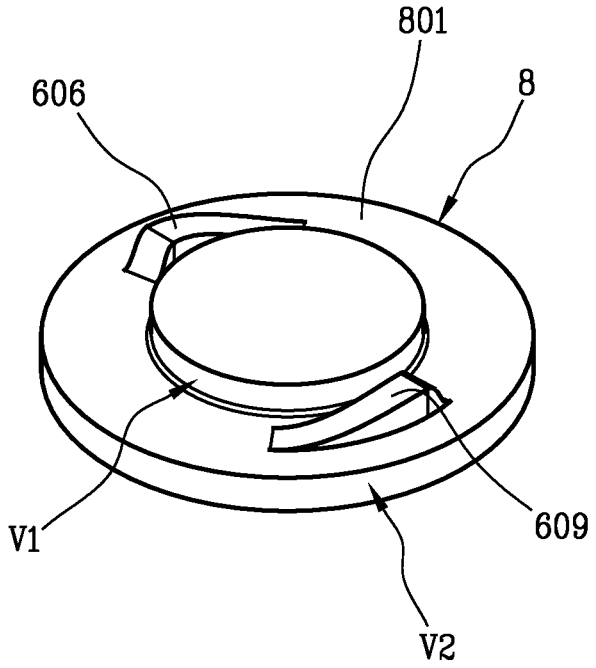
FIG. 12 is an axonometric view from outside of the additional element of FIG. 10.
Figure 13:
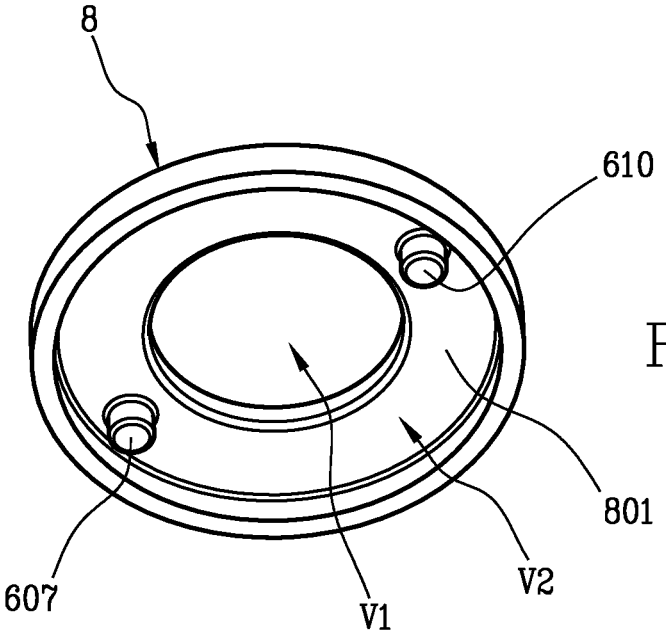
FIG. 13 is an axonometric view from inside of the additional element of FIG. 10.

It should be noticed that the upper promoting element of the variant of the cap of FIG. 10 may coincide with the outer promoting element of FIGS. 1 to 9 but it may also differ from the latter in the shape or the height of the cam and the further cam.

In detail, the upper promoting element and the intermediate promoting element are positioned externally relative to the additional element 8. In more detail, the upper promoting element and the intermediate promoting element are positioned in the free space 306, between the spacer wall 305 and the additional element 8.

Thanks to the additional element 8, configured for containing the product P in a sealed way, and thanks to the cam, the cam follower 606, the pin 607 and also the further cam, the further cam follower 609 and the further pin 610, opening of the inner portion 401 at the breakable portion 403 in a simple and inexpensive way is guaranteed.

What was previously said applies, that is to say, that, in one alternative embodiment of the cap 1 according to this invention, it is possible for only the cam, the cam follower 606 and the pin 607 to be present.

In use, in an initial movement step of the cap 1 from the closing position to the opening position, what was previously said about the cap of FIGS. 1 to 9 applies. The outer shell 3 begins to move axially away from the container 2 whilst the outer flange 402 of the closing element remains hooked to the outer shell 3, thanks to the hooking element 304, and does not rotate together with the shell 3 thanks to the fact that the sealing element 405 is retained by friction against the inner wall 205 of the neck 201. The upper promoting element, made as the cam, fixed to the outer shell 3, begins to engage with the intermediate promoting element, made as the cam follower 606, which in turn stresses the supporting element made as the pin 607. The pin 607, stressing the breaking stretch 403' of the breakable portion 403, near the hinge stretch 403", begins to create the supplying outlet 7 in the inner portion 401, opening the chamber 5.

Then, during a further movement step after the initial step, the further cam also begins to engage with the further cam follower 609 in such a way as to stress the further pin 610, for increasing the dimensions of the supplying outlet 7 and increasing the inclination of the zone 404 delimited by the breaking stretch 403' around the hinge stretch 403", positioning it inside the mouth 202.

In another further movement step, after the further step, the supplying outlet 7 has the maximum size but the coupling structure 303 of the outer shell 3 is not yet completely disengaged from the coupling structure 203 of the container 2 in order to guarantee that the product P is supplied into the container 2 when the cap 1 is still joined to the container 2.

Therefore, it may be noticed that the closing cap 1 of FIGS. 1 to 9 is easy to make, since it only comprises the outer shell 3 and the inner component 4, but it has a containment chamber 5 which cannot be hermetically closed since the shell 3 moves away from the closing element of the inner component 4 in order to be able to axially stress the inner portion 401.

In contrast, the containment chamber 5 of the closing cap 1 of FIGS. 10 to 13 is hermetically sealed since the cap comprises, in addition to the outer shell 3 and the inner component 4, also the additional element 8 which, remaining fixed to the inner component 4 when the shell 3 moves away from the closing element, can be fixed by means of adhesive or welding to the closing element itself, thereby causing the hermetic sealing of the containment chamber 5.

The closing cap 1 of FIG. 18 differs from that of FIGS. 10 to 13 since it comprises the inner component 4' in which the inner portion 401' has the shape of a cup-shaped body.

It should be noticed that, without restricting the general scope of the invention, the inner component 4' may advantageously be applicable to all closing caps 1 previously described and to those which will be described below, if a containment chamber 5 having larger volume is necessary.

As already described, the inner portion 401' has the shape of a cup-shaped body which extends from the outer flange 402 and is configured for being positioned inside the mouth 202 when the closing cap 1 is coupled to the neck 201 of the container 2.

In other words, the inner portion 401' extends on the opposite side to the end wall 302.

The inner portion 401' comprises a base wall 406 and a circumferential wall 407, which delimit a cavity.

Preferably, the circumferential wall 407 has a tubular shape, is coaxial with the longitudinal axis X and, from it, the outer flange 402 extends radially.

The sealing element 405, if optionally present, is positioned externally relative to the circumferential wall 407.

It should be noticed that the base wall 406 of the inner portion 401' has the breakable portion 403, which comprises the breaking stretch 403' and the hinge stretch 403", as previously illustrated.

Advantageously, compared with the closing cap 1 of FIGS. 10 to 13, the containment chamber 5 of FIG. 18 has a larger volume. In fact, the containment chamber 5 for the product P is defined by the cavity made in the additional element 8 and also by the cavity made in the cup-shaped body of the inner portion 401'.

What was previously said relative to the fact that the opening promoting assembly 6 comprises an upper promoting element, fixed to the outer shell, an intermediate promoting element fixed to the intermediate wall 801, and a supporting element positioned in the chamber 5, between the intermediate wall 801 and the closing element also applies here.

Therefore, the fact that the pin 607, and optionally the further pin 610 are present continues to apply, as previously described, the pins respectively positioned so that they are axially aligned with the cam follower 606, and optionally with the further cam follower 609, so that the latter axially stress the pin 607, and optionally the further pin 610, and consequently the pin 607 and the further pin 610 stress the inner portion 401'. Since the portion 401' is cup-shaped, the pin 607 and optionally the further pin 610 axially stress the base wall 406 of the inner portion 401' and are of a suitable length for engaging with the base wall 406 itself.

It has been stated that the inner component 4' in which the cup-shaped inner portion 401' is provided is advantageously applicable to all of the closing caps 1 according to this invention.

For example, the inner component 4' may also be used advantageously also in a variant, not illustrated, of the closing cap 1 of FIG. 1, or of FIG. 6, by positioning the inner promoting element so that it is fixed to the inner portion 401'. For example, the cam follower 602, and optionally the further cam follower 604, may be positioned in the base wall 406, whilst the cam 601, and optionally the further cam 603, as well as the containment wall 307 may be made having suitable length so that they engage with the base wall 406.

As illustrated in FIGS. 14 to 16, a different variant of the cap 1 is described, which comprises a shell 3 provided with the spacer wall 305, the containment wall 307, and the containment chamber 5 described with reference to FIGS. 1 to 9.

The containment wall 307 extends as far as an abutment edge 308, configured for abutting the inner portion 401.

In this variant too, advantageously but optionally, the inner portion 401 has the breakable portion 403 comprising the breaking stretch 403' and the hinge stretch 403", as previously illustrated.

Again in this variant, advantageously but optionally, the inner component 4' may have the cup-shaped inner portion 401' having the base wall 406 and in that case the containment wall 307 may have a suitable length for ensuring that the abutment edge 308 abuts the base wall 406.

The opening promoting assembly 6 comprises the abutment edge 308 and a deforming element 310, which is positioned on the end wall 302 between the spacer wall 305 and the containment wall 307 and inside it delimits a pressure portion 311. In fact, the deforming element 310 is configured for deforming towards the container 2 when the pressure portion 311 is axially stressed manually by a user, in such a way that the abutment edge 308 consequently stresses the inner portion 401, or 401', and the inner portion 401, or 401', breaks at the breakable portion 403. The deforming element 310 may, for example, be made as an annular groove made in an inner surface of the end wall 302, and, that is to say, facing towards the container 2, which promotes a deformation of the end wall 302 towards the container 2.

The abutment edge 308 may be shaped only to apply a pressure but, alternatively, may be shaped like a cutting edge for promoting breakage of the breakable portion 403.

According to one embodiment of the cap 1, the deforming element 310 may change colour (tending to turn white) at the moment of deformation, so as to render evident the fact that the containment chamber 5 has been opened. Advantageously, this would allow elimination of a closing cap security band if necessary, and consequently also of a stop ring of the neck 201 of the container 2, consequently making both the closing cap 1 and the neck 201 of the container 2 lighter.

Alternatively, according to one variant of the cap disclosed, not illustrated, optionally the shell 3 may be made as illustrated in FIG. 6, that is to say, comprising the end wall 317 previously described shaped with double height, which is provided with the outer annular zone 318 and the central zone 319. In this case, the deforming element 310 is made in the outer annular zone 318. That variant of the cap 1 is particularly advantageous when a containment chamber 5 with increased space is necessary.

In use, as shown in FIG. 16, when a user presses the pressure portion 311, the deforming element 310 deforms towards the container 2 and the interaction between the abutment edge 308 and the inner portion 401, or 401', creates the supplying outlet 7 and the product P outflow, rotating the zone 404 delimited by the breaking stretch 403' of the breakable portion 404 around the hinge stretch 403".

FIG. 17 shows a further variant of the cap of FIG. 1, which differs from the caps of FIGS. 1 to 16 since it does not have the spacer wall 305.

According to this variant, the outer shell 3 comprises a delimiting wall 312, which extends from the end wall 302, is internally preferably coaxial with the lateral wall 301 and extends as far as a contact edge 313 configured for making contact with the inner portion 401.

Again, the containment chamber 5 is defined between the delimiting wall 312 and the end wall 302 and is closed by the inner portion 401.

In this variant too, advantageously but optionally, the inner portion 401 has the breakable portion 403 comprising the breaking stretch 403' and the hinge stretch 403", as previously illustrated.

Again in this variant, advantageously but optionally, the inner component 4' may have the cup-shaped inner portion 401' and in that case the delimiting wall 312 may have a suitable length for ensuring that the contact edge 313 makes contact with the base wall 406.

In this variant, the end wall 302 comprises a pressure part 314, externally delimited by the delimiting wall 312, which is positioned perpendicularly to the axis X, and an outer annular part 315, extending from the lateral wall 301, which is in contact with the outer flange 402. In detail, the outer annular part 215 is also positioned perpendicularly to the axis X.

According to this variant, the opening promoting assembly 6 comprises the contact edge 313 and a connecting part 316 between the outer part 315 and the pressure part 314, the connecting part 316 being configured for deforming towards the container 2 when axially stressed manually by a user, in such a way that the contact edge 313 consequently stresses the inner portion 401, or 401' and the inner portion 401, or 401', breaks at the breakable portion 404.

It should be noticed that the connecting part 316 is angled since it connects the outer part 315, in contact with the closing element and perpendicular to the axis X, with the pressure part 314, also perpendicular to the axis X, whose distance from the closing element is the dimension of the delimiting wall 312. The delimiting wall 312 performs both a function of containing the product P and a function of spacer between the end wall 302 and the closing element.

In use, when a user presses the pressure part 314, the connecting part 316 deforms towards the container 2 and the interaction between the contact edge 313 and the inner portion 401, or 401', creates the supplying outlet 7 and the product P outflow, rotating the zone 404 delimited by the breaking stretch 403' of the breakable portion 404 around the hinge stretch 403".

The closing cap 1 according to this invention is easy to make.

The method for making the closing cap comprises making an outer shell 3 and positioning the outer shell 3 in such a way as to leave accessible the concavity defined between the lateral wall 301 and the end wall 302, for example by positioning that concavity upwards. If the shell 3 comprises the double-height containment wall 307, the method comprises filling the cavity defined between the end wall 302 and the containment wall 307 with the product P and making the containment chamber 5 by bringing the inner component 4, or 4', into contact with the spacer wall 305 and the containment wall 307, in the cap 1 of FIGS. 1 to 9 and in the variant of FIGS. 14 to 16, or the containment wall 317, in the different variant of FIG. 17.

At the moment when the closing element is placed in contact with the spacer wall 305, or the containment wall 307, the outer flange 402 of the closing element is forced to move beyond the hooking element 304, projecting towards the inside of the shell 3, in such a way that, in use, the inner component 4 is retained inside the shell 3 by means of the interference between the hooking element 304 and the outer flange 402.

In contrast, regarding the variant of the cap 1 shown in FIGS. 10 to 13, and in FIG. 18, the method for making the closing cap comprises, as previously described, making an outer shell 3 and positioning the outer shell 3 in such a way as to leave accessible the concavity defined between the lateral wall 301 and the end wall 302, for example by positioning that cavity upwards.

The method comprises filling the cavity of the additional element 8 with the product P and joining, for example by means of adhesive or welding, the additional element 8 to the inner component 4, or 4', in such a way as to place the inner component 4, or 4', in a position in which it closes the containment chamber 5. In detail, the containment chamber 5 is sealed by means of the closing element.

Then, the additional element 8, joined to the inner component 4, or 4', is placed inside the cavity defined in the shell 3 by the lateral wall 301 and the end wall 302. The additional element 8 may be shaped in such a way as to make contact with the end wall 302 or be contained in the free space 306 without making contact with the end wall 302.

Again, during insertion, the outer flange 402 of the closing element is forced to move beyond the hooking element 304 for retaining the inner component 4, or 4', in the shell 3.

An alternative embodiment of the method for making this cap 1 comprises positioning the additional element 8 inside the cavity defined in the shell 3 by the lateral wall 301 and the end wall 302 and, then, filling the cavity of the additional element 8 with the product P, then subsequently joining, for example by means of adhesive or by gluing, the inner component 4, or 4', to the additional element 8 for closing the containment chamber 5, forcing the outer flange 402 to move beyond the hooking element 304 of the shell 3.

Therefore, it should be noticed that the method for making the cap 1 according to this invention comprises a reduced number of operating steps and is therefore fast and inexpensive.

Moreover, it should also be noticed that all parts of the cap 1 according to this invention can be made by compression moulding, or injection moulding, of plastic material and do not require expensive moulding equipment.

In fact, the outer shell 3 described herein is shaped similarly to a common bottle top and can be moulded using moulding equipment similar to existing moulding equipment. Even the inner component 4, or 4', as well as the additional element 8 are easy to make by compression moulding, or injection moulding. Therefore, advantageously, the cap according to this invention may be made by means of compression moulding, or injection moulding, in a simple, inexpensive way.

The invention claimed is:

1. A closing cap (1) for a container (2) comprising:

an outer shell (3) which extends along a longitudinal axis (X) and comprises a lateral wall (301), which extends about the axis (X), in particular having a shape which is tubular and coaxial with the axis (X), and an end wall (302; 317), which closes the lateral wall (301) at one end for delimiting a concavity; wherein the lateral wall (301) is internally provided with a coupling structure (303), configured for removably coupling the cap (1) to a neck (201) of the container (2) in such a way that the cap (1) is movable from a closing position, in which the cap (1) closes a mouth (202) of the container (2), to an opening position;

an inner component (4; 4') positioned for closing the mouth (202) of the container (2), when the cap (1) is in the closing position, comprising a closing element (401, 401', 402) provided with an inner portion (401; 401'), which is configured, in use, for facing the mouth (202), and an outer flange (402), extending externally relative to the inner portion (401; 401'), which is configured for fixing to the outer shell (3); and a chamber (5), suitable for containing a product (P) intended to be supplied into the container (2) through the mouth (202), which is at least partly delimited by the inner portion (401; 401'); wherein the cap (1) comprises an opening promoting assembly (6) and the inner portion (401; 401') comprises a breakable portion (403), the opening promoting assembly (6) being configured for axially stressing the breakable portion (403) in such a way as to create a supplying outlet (7) in the inner portion (401; 401') and to make the product (P) come out of the chamber (5), supplying the product (P) into the container (2) through the mouth (202);

wherein the outer shell (3) comprises a spacer wall (305), which extends from the end wall (302; 317) and is internally coaxial relative to the lateral wall (301), the spacer wall (305) being configured for making contact with the closing element (401, 401', 402) and for spacing the latter from the end wall (302; 317) defining a free space (306) between the end wall (302; 317), the spacer wall (305) and the closing element (401, 401', 402).

2. The cap according to claim 1, wherein the opening promoting assembly (6) comprises an outer promoting element (601; 603) fixed to the outer shell (3) and an inner promoting element (602; 604) fixed to the inner portion (401; 401') which operate in conjunction with each other during a movement of the cap (1) from the closing position to the opening position for creating the supplying outlet (7).

3. The cap according to claim 2, wherein the outer promoting element (601; 603) and the inner promoting element (602; 604) respectively comprise a cam (601) and a cam follower (602) which are configured for making contact and for producing a gradually increasing axial shifting between the end wall (302; 317) and the inner portion (401; 401'), during the movement of the cap (1) from the closing position to the opening position, such that it axially stresses the breakable portion (403).

4. The cap according to claim 3, wherein the breakable portion (403) is annular and comprises a breaking stretch (403'), which is weakened and extends over an angle of less than 360°, and a hinge stretch (403"), which is not weakened, around which a zone (404) delimited by the breaking stretch (403') can be rotated, for creating the supplying outlet (7) and for making the product (P) come out, and wherein the outer promoting element (601; 603) and the inner promoting element (602; 604) respectively additionally comprise a further cam (603) and a further cam follower (604), which are both positioned in an equally angular relationship relative to the cam (601) and the cam follower (602), the cam (601) and the cam follower (602) being positioned at a distance from the hinge stretch (403") for producing stress to cause a first break of the breakable portion (403), in an initial movement step of the cap (1) from the opening position to the closing position, the further cam (603) and the further cam follower (604) being positioned near the hinge stretch (403") for increasing a dimension of the supplying outlet (7) after the first break.

5. The cap according to claim 2, wherein the outer shell (3) comprises a containment wall (307), which extends from the end wall (302) until it makes contact with the inner portion (401; 401'), the containment chamber (5) being defined between the containment wall (307) and the end wall (302; 317) and being closed by the inner portion (401; 401'), and wherein the outer promoting element (601; 603) and the inner promoting element (602; 604) are positioned externally relative to the containment wall (307).

6. The cap according to claim 5, wherein the outer shell (3) comprises a spacer wall (305), which extends from the end wall (302; 317) and is internally coaxial relative to the lateral wall (301), the spacer wall (305) being configured for making contact with the closing element (401, 401', 402) and for spacing the latter from the end wall (302; 317) defining a free space (306) between the end wall (302; 317), the spacer wall (305) and the closing element (401, 401', 402), and wherein the containment wall (307) is positioned in the free space (306), the outer promoting element (601; 603) as well as the inner promoting element (602; 604) also being positioned in the free space (306), between the spacer wall (305) and the containment wall (307).

7. The cap according to claim 1, wherein the outer shell (3) comprises a containment wall (307), which extends from the end wall (302; 317) until it makes contact with the inner portion (401; 401'), the containment chamber (5) being defined between the containment wall (307) and the end wall (302; 317) and being closed by the inner portion (401; 401').

8. The cap according to claim 1, wherein the breakable portion (403) is annular and comprises a breaking stretch (403'), which is weakened and extends over an angle of less than 360°, and a hinge stretch (403"), which is not weakened, around which a zone (404) delimited by the breaking stretch (403') can be rotated, for creating the supplying outlet (7) and for making the product (P) come out.

9. The cap according to claim 1, and comprising an additional element (8) fixed to the closing element (401, 401', 402), which comprises a cavity suitable for containing the product (P), the inner portion (401; 401') sealingly closing the cavity to form the containment chamber (5).

10. The cap according to claim 9, wherein the additional element (8) comprises an intermediate wall (801), which is interposed between the end wall (302; 317) and the closing element (401, 401', 402), the opening promoting assembly (6) comprising an upper promoting element, fixed to the outer shell (3), an intermediate promoting element (606; 609) fixed to the intermediate wall (801), a supporting element (607; 610) positioned in the containment chamber (5) between the intermediate wall (801) and the closing element (401, 401', 402), which operate in conjunction with each other during the movement of the cap (1) from the closing position to the opening position for creating the supplying outlet (7).

11. The cap according to claim 10, wherein the upper promoting element and the intermediate promoting element (606; 609) are positioned externally relative to the additional element (8) and respectively comprise a cam and a cam follower (606) which are configured for making contact and for producing a gradually increasing axial shifting between the end wall (302; 317) and the intermediate wall (801), during the movement of the cap (1) from the closing position to the opening position.

12. The cap according to claim 11, wherein the supporting element (607; 610) comprises a pin (607), positioned in alignment with the cam follower (606), in such a way that the latter axially stresses the pin (607) and the pin (607) consequently stresses the inner portion (401; 401').

13. The cap according to claim 9, wherein the breakable portion (403) is annular and comprises a breaking stretch (403'), which is weakened and extends over an angle of less than 360°, and a hinge stretch (403"), which is not weakened, around which a zone (404) delimited by the breaking stretch (403') can be rotated, for creating the supplying outlet (7) and for making the product (P) come out.

14. The cap according to claim 11, wherein the breakable portion (403) is annular and comprises a breaking stretch (403'), which is weakened and extends over an angle of less than 360°, and a hinge stretch (403"), which is not weakened, around which a zone (404) delimited by the breaking stretch (403') can be rotated, for creating the supplying outlet (7) and for making the product (P) come out, and wherein the upper promoting element additionally comprises a further cam, the intermediate promoting element (606; 609) additionally comprises a further cam follower (609); the further cam and the further cam follower (609) are both positioned in an equally angular relationship relative to the cam and the cam follower (606); the cam and the cam follower (606) being positioned at a distance from the hinge stretch (403") for producing stress to cause a first break of the breakable portion (403), in an initial movement step of the cap (1), the further cam and the further cam follower (609) being positioned near the hinge stretch (403") for increasing a dimension of the supplying outlet (7) after the first break.

15. The cap according to claim 12, wherein the breakable portion (403) is annular and comprises a breaking stretch (403'), which is weakened and extends over an angle of less than 360°, and a hinge stretch (403"), which is not weakened, around which a zone (404) delimited by the breaking stretch (403') can be rotated, for creating the supplying outlet (7) and for making the product (P) come out, and wherein the upper promoting element additionally comprises a further cam, the intermediate promoting element (606; 609) additionally comprises a further cam follower (609); the further cam and the further cam follower (609) are both positioned in an equally angular relationship relative to the cam and the cam follower (606); the cam and the cam follower (606) being positioned at a distance from the hinge stretch (403") for producing stress to cause a first break of the breakable portion (403), in an initial movement step of the cap (1), the further cam and the further cam follower (609) being positioned near the hinge stretch (403") for increasing a dimension of the supplying outlet (7) after the first break, and wherein the supporting element (607; 610) comprises a further pin (610), positioned aligned with the further cam follower (609) in such a way that the latter axially stresses the further pin (610) and the further pin (610) consequently stresses the inner portion (401; 401').

16. The cap according to claim 1, wherein the outer shell comprises a containment wall (307), which extends from the end wall (302), the containment wall (307) extending as far as an abutment edge (308) configured for abutting the closing element (401, 401', 402), the containment chamber (5) being defined between the containment wall (307) and the end wall (302) and being closed by the inner portion (401; 401'); wherein the opening promoting assembly (6) comprises the abutment edge (308) and a deforming element (310), positioned on the end wall (302) externally relative to the containment wall (307) and inside it delimiting a pressure portion (311), the deforming element (310) being configured for deforming towards the container (2) when the pressure portion (311) is axially stressed manually by a user, in such a way that the abutment edge (308) consequently stresses the inner portion (401; 401').

17. The cap according to claim 16, wherein the breakable portion (403) is annular and comprises a breaking stretch (403'), which is weakened and extends over an angle of less than 360°, and a hinge stretch (403"), which is not weakened, around which a zone (404) delimited by the breaking stretch (403') can be rotated, for creating the supplying outlet (7) and for making the product (P) come out.

18. The cap according to claim 1, wherein the end wall (317) comprises an outer annular zone (318), which extends from the lateral wall (301) and has a first distance from the closing element (401, 401', 402), for example equal to the height of the spacer wall (305), and a central zone (319) having a second distance from the closing element (401, 401', 402), wherein the second distance is greater than the first distance, for making the central zone (319) project outwards and define a larger containment chamber (5).

19. The cap according to claim 1, wherein the inner component (4;4') additionally comprises a sealing element (405), extending from the closing element (401, 401', 402) and configured for being positioned inside the mouth (202) and for forming a seal with an inner portion (205) of the neck (201) of the container (2).

20. The cap according to claim 1, wherein the closing element (401, 402) of the inner component (4) is shaped like a planar disk and has the inner portion (401) which is planar, and extending from it, in a planar way, the outer flange (402).

21. The cap according to claim 1, wherein the closing element (401', 402) of the inner component (4') has the inner portion (401') shaped like a cup-shaped body and extending from it the outer flange (402), which is planar.

* * * * *